US006846130B2

(12) United States Patent
Goughnour

(10) Patent No.: US 6,846,130 B2
(45) Date of Patent: Jan. 25, 2005

(54) METHOD AND APPARATUS FOR ENHANCEMENT OF PREFABRICATED EARTH DRAINS

(75) Inventor: R. Robert Goughnour, Leesburg, VA (US)

(73) Assignee: Nilex Construction, LLC, Centennial, CO (US)

( * ) Notice: Subject to any disclaimer, the term of this patent is extended or adjusted under 35 U.S.C. 154(b) by 0 days.

(21) Appl. No.: 10/352,583

(22) Filed: Jan. 28, 2003

(65) Prior Publication Data

US 2004/0146357 A1 Jul. 29, 2004

(51) Int. Cl.[7] ..... E02B 11/00
(52) U.S. Cl. ..... 405/50; 405/49
(58) Field of Search ..... 405/36, 43–45, 405/50; 166/308.1, 280.2, 177.5

(56) References Cited

U.S. PATENT DOCUMENTS

| | | | | |
|---|---|---|---|---|
| 1,598,300 A | | 8/1926 | Moran | |
| 4,047,569 A | * | 9/1977 | Tagirov et al. | 166/308.1 |
| 4,051,900 A | * | 10/1977 | Hankins | 166/280.2 |
| 4,386,806 A | * | 6/1983 | Axen et al. | 405/264 |
| 4,582,611 A | | 4/1986 | Wang | |
| 5,626,437 A | * | 5/1997 | Hunt et al. | 405/128.45 |
| 5,709,505 A | * | 1/1998 | Williams et al. | 405/128.2 |
| 5,800,090 A | | 9/1998 | Goughnour | |
| 6,312,190 B1 | | 11/2001 | Goughnour | |
| 6,660,693 B2 | * | 12/2003 | Miller et al. | 166/305.1 |

OTHER PUBLICATIONS

K. R. Massarsch and M. Kamon "Performance of Driven Sand Drains", Proc. 13th Intl. Conf. SMFE, Helsinki, 1983, 659–662.

B.B. Broms and P. Boman "Lime Columns—A New Foundation Method", Jour. of the Geot. Engr. Div., Proc of ASCE, vol. 105, No. Gt4, Apr., 1979.

K. R. Massarsch "New Aspects of Soil Fracturing in Clay", Jour. of the Geot. Engr. Div., Proc. ASCE, vol. 104, No. GT8, Aug., 1978.

G. W. Jaworski, J. M. Duncan, and H. B. Seed, "Laboratory Study of Hydraulic Fracturing", Jour. of the Geot. Engr. Div., Proc. ASCE, vol. 107, No. GT6, Jun., 1981.

L. Murdoch, B. Slack, S. Siegrist, S. Vesper and T. Meiggs, "Hydraulic Fracturing Advances", *Civil Engineering*—ASCE, vol. 67, No. 5, May 1997, pp. 10A–12A.

S. N. Venkatraman, J. R. Schuring, T. .M. Boland and D. S. Kosson, "Fracturing for In–Situ Bioremediation", *Civil Engineering*—ASCE, vol. 66, No. 3, Mar. 1996, pp. 14A–16A.

* cited by examiner

*Primary Examiner*—Frederick L. Lagman
(74) *Attorney, Agent, or Firm*—Carothers & Carothers

(57) ABSTRACT

The effectiveness of a prefabricated earth drain installed in a generally vertical manner in soil is improved for enhancing the expelling of pore water from the soil to the surface. The soil surrounding the earth drain is hydraulically fractured either while the drain is in place or while the earth drain is being installed. Propping agents may also be supplied to the surrounding soil after hydraulic fracturing for propping fractures in the soil to maintain continuous flow to the drain. Radially extending fissures may also be formed in the surrounding soil either mechanically or through the use of hydraulic jetting and a propping agent is supplied to these fissures either in the form of particulate material or a continuous ribbon of porous filter fabric.

21 Claims, 6 Drawing Sheets

METHOD AND APPARATUS FOR ENHANCEMENT OF PREFABRICATED EARTH DRAINS

FIELD OF THE INVENTION

This invention relates generally to soil improvement, and more particularly to improvements in vertical prefabricated earth drains used for soil consolidation acceleration, liquefaction mitigation, remediation and contaminant removal.

BACKGROUND OF THE INVENTION

When loads are placed on the surface of soft, saturated clay deposits, large settlements often result because of compression of the clay material. In saturated material, this settlement can take place only as pore water is expelled. If the permeability of the compressible soil is very low, this process takes place very slowly. Total settlements of several meters are common and often take years to occur. This time-dependent process is called consolidation. A process called sand drains and surcharging has been used in these cases since the 1920's (See D. E. Moran, U.S. Pat. No. 1,598,300).

In this process sand drains (columns of sand) are installed vertically on a regular area pattern through the soft layer to be treated. After the sand drains are installed, a sand or gravel drainage blanket one to three feet thick is placed over the drains to permit water to flow out of the drains. An earth embankment is placed over this drainage blanket. The thickness of the embankment or surcharge is normally calculated to produce loading roughly 10% greater than the anticipated final design load planned for the project.

The sand drains now provide free drainage paths within the clay mass. Without drains, drainage from any point within the clay must take place vertically, either to the surface, or downward to a permeable soil layer below, if such layer is present. With drains present, the drainage distance from any point within the clay is to the nearest drain. Drains are spaced so that drainage paths are much shortened, and consolidation occurs much more rapidly. The surcharge is left in place until the consolidation process is nearly complete (commonly about 90%). This creates a condition where the soil skeleton (or soil grains) is loaded to a level equal to or somewhat greater than the anticipated design load. The surcharge is then removed and the project proceeds. Since the soft soil skeleton has been precompressed to a load somewhat greater than the design load, no more settlement occurs.

In the late 1960's and early 1970's, wick drains were developed as an alternative to sand drains. Wick drains are not truly wicks, but are composite drains composed of an extruded flexible plastic core shaped to provide drainage channels when the core is wrapped in a special filter fabric. See, for example, U.S. Pat. No. 5,820,296. The filter fabric (geofabric or geotextile) acts as a filter, constructed with opening sizes which prevent the entrance of soil particles, but allow pore water to enter freely. The finished wick material or drain is strip or band-shaped, typically about ⅛ to ¼ inch thick, and approximately 4 inches wide. It is provided in rolls containing 800 to 1000 feet of drain. An example manufacturer is Nilex Corporation of Englewood, Colo. USA. Its product is sold under the trademark MEBRADRAIN.

More recently wick drains have been used to aid in the removal of contaminants from soil or aquifers (See, for example, U.S. Pat. No. 4,582,611). In one variation of this process, wick drains are inserted into the contaminated soil or aquifer, water is injected into one or more of the wick drains, and water with contaminates is removed from one or more wick drains.

Another recent development is the use of larger composite drains as a replacement for the sand or gravel drainage blanket. These drains are similar to wick drains but with much larger cross sectional area. They are placed to accept drainage out of the vertical drains and to provide horizontal drainage from under the surcharge. This "under drain system" is very efficient, and is usually cost-effective when compared with a sand or gravel layer.

In another variation, the surcharge may be replaced by a system that applies atmospheric pressure to the ground surface. To apply this method an impervious membrane is placed over the area to be consolidated. The edges of this membrane are placed into a trench and buried to provide an airtight seal around the perimeter of the membrane. A vacuum is then drawn from under the membrane. A system of horizontal drains, as just mentioned, is placed under the membrane and distributes the effects of the vacuum uniformly throughout the treated area. The maximum pressure that can be realized in practice is about 70% to 80% of atmospheric, and is equivalent to approximately a 15-foot high embankment.

Another application for vertical prefabricated drains in ground improvement is for liquefaction mitigation and remediation. One of the most destructive effects of earthquakes is their effect on deposits of saturated loose, fine sand or silty sand, causing a phenomenon known as liquefaction. When liquefaction occurs the soil mass loses all shear strength and behaves temporarily as a liquid. Such temporary loss of shear strength can have catastrophic effects on earthworks or structures founded on these deposits. Major landslides, lateral movement of bridge supports, settling or tilting of buildings, and failure of waterfront structures have all been observed in recent years, and efforts have been increasingly directed toward development of methods to prevent or reduce such damage.

When loose sand is subjected to repeated shear strain reversals, such as caused by an earthquake, the volume of the sand will decrease. If the sand is saturated and drainage out of the sand is prevented, it will be understood that since the volume of the sand is decreasing, the pressure of the water must increase. As the water pressure becomes greater the grain-to-grain contact pressure in the sand must become smaller and smaller. When this grain-to-grain contact pressure becomes zero, the entire sand mass will lose all shear strength and will act as a liquid. This phenomenon is known as liquefaction and can occur in loose, saturated sand deposits as a result of earthquakes, blasting, or other shocks.

Treatment of soil to improve liquefaction resistance has taken the form of densifying the soil, providing reinforcing elements within the soil, providing drainage, or some combination of these. Traditionally the most cost effective of these alternatives has been the use of stone or gravel columns to provide reinforcement and/or drainage. Such columns are spaced at intervals within the liquefiable soil. Although the stone or gravel column method has been used extensively in the past, recent research has called into question its effectiveness. For example, see "Drainage Capacity of Stone Columns or Gravel Drains for Mitigating Liquefaction," Boulanger, R. W., Idriss, I. M., Stewart D. P., Hashish, Y, and Schmidt, B., $2^{nd}$ Geotechnical Earthquake Engineering and Soil Dynamics Conference, Seattle, Vol. I, 678–690, 1997, and "Mechanical Behavior of Stone Columns Under Seismic Loading," Goughnour, R. R. and Pestana, J. M., 2nd Int. Conf. On Ground Improvement Techniques, 7–9 October, 1998, Singapore.

One recently developed method of treating liquefiable soil for earthquake protection, comprises a plurality of substantially vertical prefabricated drains positioned at spaced intervals in the liquefiable soil and a reservoir, which is adapted for draining off water that is expelled from these composite drains (see U.S. Pat. No. 5,800,090). The object is to provide pore water pressure relief from a series of spaced locations within a liquefiable soil by providing an open drainage path, which operates as efficiently as possible-i.e. requires as little pressure as possible to move the required amount of water.

In the previous application where vertical drains were used for consolidation acceleration, drainage through the drains normally takes place over a period of several weeks, months, or even years. In this case, drainage must take place during strong shaking of the earthquake event, which is only a matter of seconds. The drains used in this application must provide flow capacity at least two orders of magnitude greater than normal wick drains.

One product that meets this requirement is the larger composite drains as mentioned above. This product is similar to wick drains but with a thickness of 1 to 1½ inches, and a width of 6 inches or more. Another recently developed product is corrugated plastic pipe. This product is perforated or slotted and can be wrapped in a geofabric. When used for liquefaction mitigation this product will have an inside diameter of from 2 to 10 or 12 inches.

Installation of vertical drains is accomplished by means of specialized equipment, consisting of a crane-mounted, vertical mast housing a special installation mandrel. The mandrel, containing the drain, is intruded by force directly into the ground from the bottom of the mast. After reaching the desired depth, the mandrel is withdrawn back into the mast, leaving the undamaged drain in place within the soil. For example, see U.S. Pat. No. 5,213,449. Sometimes vertical vibration is applied to the mandrel to aid in penetration. Typical spacing for wick drains is from three to ten feet. This well proven method of ground improvement has found extensive application where foundation materials are saturated and compressible, with moisture contents up to 100%. Such foundation materials include clays; soft, fine silts; organic deposits; and peat or "muck". This method is very cost-effective and has virtually replaced the older sand drain method.

Installation of drains intended for liquefaction remediation (earthquake drains) is accomplished with similar equipment. The mandrel is larger to accommodate a larger drain cross sectional area. As with wick drains, vibration is often applied to the mandrel to assist in penetrating the soil. However, in this case, the primary purpose of vibration is to densify the soil, since liquefaction potential is also reduced as a result of soil densification. Commonly fins are added to the mandrel to improve transmission of vibration to the soil, thus enhancing the densification process. Densification of the soil is accomplished simultaneously with drain installation. Earthquake drains spacings normally vary from 2 to 6 or 7 feet.

U.S. Pat. No. 6,312,190 discloses a method and apparatus for enhancing the effectiveness of prefabricated composite vertical drains. This is accomplished by actively pumping water from the drain for some period of time. Temporarily pumping water from the drain will carry fine soil material out of the soil and into the drain. This suspended fine soil is pumped out of the drain and disposed of. Removal of fine soil material in the vicinity of the drain will increase the permeability of the soil near the drain, thus permanently enhancing the effectiveness of the drain.

SUMMARY OF THE INVENTION

The method and apparatus of the present invention pertain to improvements in the effectiveness of such prefabricated drains which are installed in a generally vertical manner in soil to be treated for expelling pore water from the soil to the surface. The primary improvement resides in fracturing the soil surrounding the drain by applying hydraulic fracturing.

In one embodiment the drain is provided in the form of a perforated tube and fracturing of the surrounding soil is accomplished by providing a seal between upper exterior portions of the tube and the surrounding soil, and by further subjecting fluid within the tube to hydraulic fracturing pressures for fracturing surrounding soil with fluid under pressure applied via the perforations in the tube. Hydraulic fracturing pressures may be applied throughout the entire internal depth of the tube or the hydraulic fracturing pressures may be confined by subjecting fluid in a preselected segment of the tube only with hydraulic fracturing pressure. This latter method may be accomplished by providing spaced packer units within the tube.

In addition to the novel feature of fracturing soil surrounding the prefabricated drain novelty is further provided by supplying a propping agent to the surrounding soil after fracturing for propping fractures in the soil. As an alternative, the present invention also teaches the supplying of a propping agent to the surrounding soil prior to fracturing for propping fractures in the soil thereafter created by fracturing.

A further embodiment of the present invention provides the alternative of hydraulically fracturing the surrounding soil as the drain is being installed with fluid under pressure. This embodiment may be further enhanced by supplying the fracturing fluid under pressure to the surrounding soil in pulses. In this embodiment, a propping agent may also be supplied to the surrounding soil being fractured during the step of fracturing, and, in fact, the propping agent may be supplied in direct combination with the fracturing fluid.

In yet another embodiment of the present invention, hydraulic fracturing of the soil surrounding the prefabricated drain may be omitted and radially extending fissures are instead created in the surrounding soil mechanically or with water jets and a propping agent is supplied to the radially extending fissures to prop them. In this embodiment of the present invention, the propping agent may be supplied to the fissures in the form of particulate material or as a continuous ribbon of porous filter fabric.

DESCRIPTION OF RELATED PRIOR ART PERTAINING TO HYDRAULIC FRACTURING

The concept of generating fractures in soil or rock by liquids being pumped into the formation at high pressure and high rate of flow has been recognized by the oil industry for many years, and was first applied in 1932. The importance of hydraulic fracturing in geotechnical problems was not pointed out until recently ("Hydraulic Fracturing in Field Permeability Testing," Bjerrum, L., et al., *Geotechnique*, London, England, Vo. 22, No. 2, June 1974, pp. 319–332). More recently fracturing has been used to enhance wells used for in situ soil remediation (see for example Venkatraman, S. N., Schuring, J. R., Boland, T. M., and Kosson, D. S., "Fracturing for In-Situ Bioremediation," Civil Engineering, March, 1996, 14A–16A)

It is believed that hydraulic fracturing occurs in a borehole because of the wedging action of the water acting on the walls of the hole or the wetted zone around the hole ("Laboratory Study of Hydraulic Fracturing," Jaworski, A. M., Duncan, J. M., and Seed, H. B., J. Geot. Engr. Div., Proc of A.S.C.E., Vol. 7, No. GT6, June 1981). When hydraulic fracturing is induced from a cylindrical bore, vertical cracks tend to form radially from the bore walls. These cracks can extend for some distance from the bore, thus providing preferred flow paths through the soil into the bore. This effectively increases the area through which fluid can flow from the ground into the bore. Flow of water from the soil into the bore is greatly enhanced. The prior art, however, does not suggest or perceive the possibility of using hydraulic fracturing in combination with prefabricated earth drains as taught by the present invention.

The prior art in regard to oil and gas wells also teaches that the effect of the fracture created cracks can be further enhanced by carrying a "proppant" in suspension in the fluid pumped into the formation. This proppant fills the cracks as they are created with some permeable material and assists in maintaining the crack as a preferred drainage path (see for example U.S. Pat. No. 4,051,900).

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention, wherein:

DETAILED DESCRIPTION OF PREFERRED EMBODIMENTS

Enhancement of vertical prefabricated drains in accordance with the teachings of the present invention by hydraulic fracturing of the soil surrounding the drain can be accomplished while the drain is in situ or while the drain is being installed. Enhancement of vertical drain operation by hydraulic fracturing of the soil after the drain is installed will, by necessity, apply only to tubular drains of sufficient diameter to allow access to the interior of the drain. In most instances, such drains will generally apply to drains intended for liquefaction remediation wherein the generally vertical prefabricated drains are installed on a regular area pattern as previously described with uniform spacing between the drains in a liquefiable soil.

Figure 1:
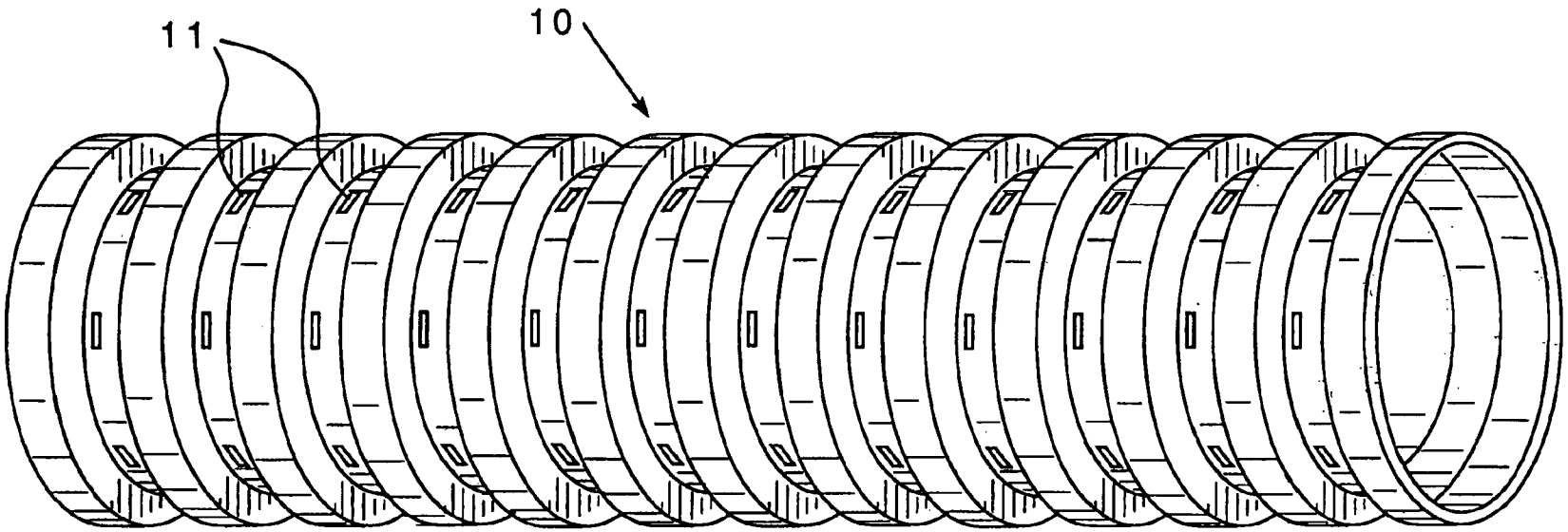
FIG. 1 is an isometric view of a corrugated and slotted or perforated plastic tube for use in one embodiment of the method and apparatus of the present invention.

One product, as previously mentioned, that meets these requirements for liquefaction remediation is a corrugated plastic pipe as illustrated in FIG. 1. The drain pipe 10 is perforated or slotted with slots 11 and the drain pipe 10 is generally wrapped, but not always, in a geofabric. The drain pipe 10 illustrated in FIG. 1 is not so wrapped. The inside diameter in this instance might generally be from 2 to 12 inches, as the circumstances may require.

Figure 2:
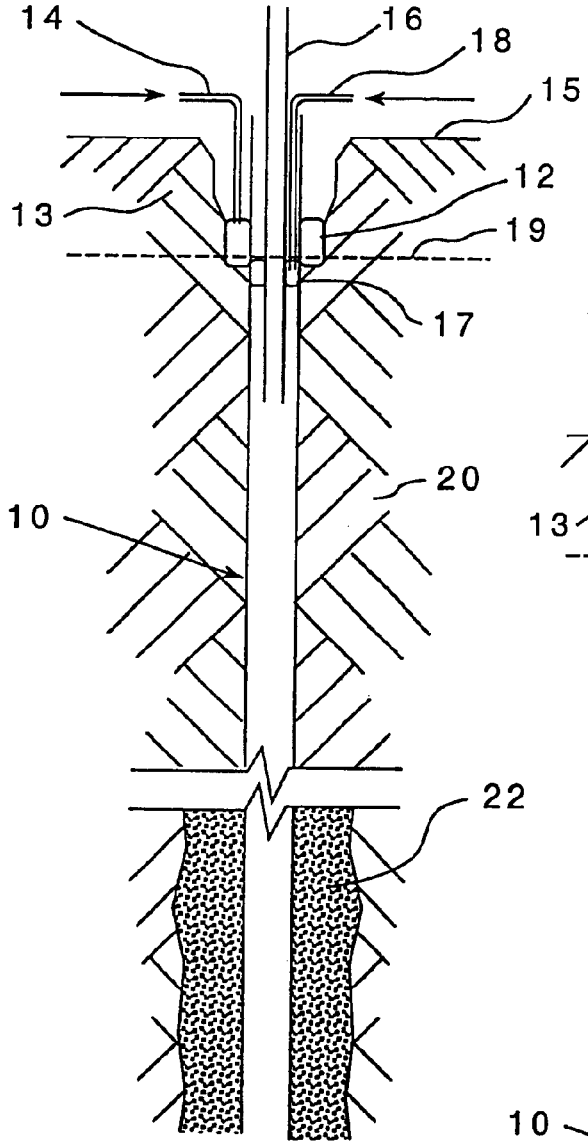
FIG. 2 is a schematic view in vertical elevation in mid cross section illustrating apparatus for hydraulically fracturing soil surrounding an earth drain in accordance with the teachings of the present invention.

Referring to FIG. 2, the method of applying hydraulic fracturing to the surrounding soil after the drain pipe 10 is installed is illustrated. The soil 13 is saturated and the ground water level is indicated at 19. The perforated drain pipe 10 is sealed with exterior packer 12 between upper exterior portions of pipe 10 and the surrounding soil 13. Exterior packer 12 is a conventional ring or "donut" shaped packer bladder which is inflated with the use of air or water under pressure through tube 14. Exterior packer 12 prevents fracture fluid from escaping around the exterior of the drain 10 to the surface 15.

A fracture fluid pipe 16 extends downwardly and concentrically into perforated pipe 10 and provides access to insert fracture fluids under pressure into the pipe 10. An interior packer 17, smaller, but similar in configuration to exterior packer 12, is installed between tube 16 and the interior of drain 10 and is inflated with air or water under pressure through tube 18 to inflate the packer and prevent the fracturing fluid from escaping from the top of drain pipe 10.

Fracturing fluid, such as air or water under pressure, is thus applied to the bottom end of tube 16 to a column of water and/or air contained in drain pipe 10 which thereby applies hydraulic fracturing pressure for fracturing surrounding soil 20 with fluid under pressure applied via the perforations 11 of pipe 10.

The pressure to be achieved to produce fracturing must be in excess of the overburden pressure at any depth plus the tensile strength of the soil. Liquefiable soil will always have a low tensile strength. The hydraulic fracturing is accomplished, in this example, by applying air pressure, water pressure, or air pressure over water. In fact, the drain pipe 10 may be filled with water or other liquid via the fracture fluid pipe 16, and then the fracturing pressure may be applied by air release from an air pressure tank. Typical fracture pressures will be maintained for a period of 5 to 20 seconds. After fracturing has occurred, the water may be pumped from the drain to further develop the preferential flow pass created by the fractures as is taught in U.S. Pat. No. 6,312,190.

Figure 3:
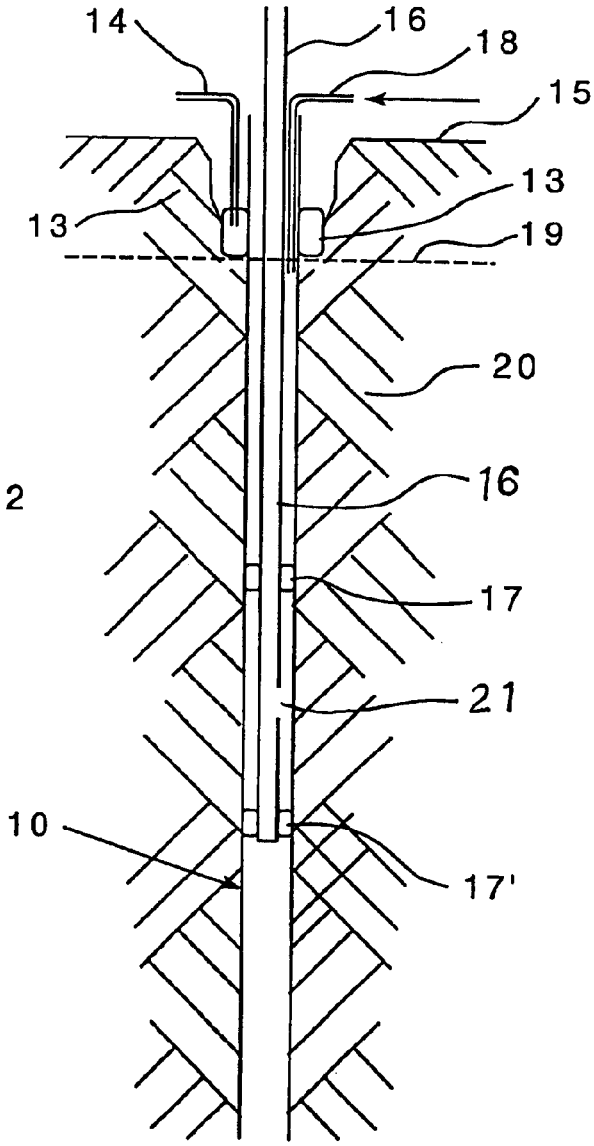
FIG. 3 is a schematic view in vertical elevation in mid cross section illustrating apparatus for hydraulically fracturing soil surrounding an earth drain in a preselected segment of the earth drain only.

The structure illustrated in FIG. 3 illustrates a variation of the structure shown in FIG. 2 wherein instead of applying fracturing pressure to the entire drain depth simultaneously as disclosed in FIG. 2, in FIG. 3, hydraulic fracturing pressure is applied only to selected depths or segments. In this arrangement, two sets of spaced internal packers 17 and 17' are employed and the bottom end of fracture fluid tube 16 is closed off and is provided with an exit 21 intermediate upper and lower internal packer units 17 and 17'. This confines the hydraulic fracturing to a preselected segment of drain pipe 10.

In yet another embodiment of the present invention, it is desirable to supply a propping agent to the surrounding soil after fracturing for propping fractures in the soil in order to maintain the flow within the fractures. A propping agent can be carried in suspension in the fracture fluid, or the propping agent may consist of some solid particulate material that penetrates the crack or cracks formed by fracturing. This particulate material holds the crack open thus maintaining an open flow path to the earth bore and ultimately to the interior of the earth drain pipe 10.

Another method in accordance with the teachings of the present invention for carrying a propping agent into the cracks or fissures is to install the drain within a preformed matrix of some granular or particulate propping agent or material as indicated, for example, at 22 in FIG. 2. The fracture fluid will then carry the particulate material 22 into the cracks as they are formed during hydraulic fracturing. Apparatus in accordance with the teachings of the present invention for installing drains within such an envelope is illustrated by the probe or mandrel 25 shown in FIGS. 4 and 5.

In this embodiment, hollow mandrel 26 is comprised of inner and outer elongate coextending concentric pipes 27 and 28 respectively having top ends 29 and 30, and the bottom ends 31 and 32 with an annular space 33 provided therebetween maintained by annularly spaced and positioned spacers 34.

Inner pipe 27 is dimensioned to receive elongate prefabricated drain pipe 10 therein as illustrated and a sacrificial bottom closure 35 closes the bottom end of pipe 10, and when pipe 10 is in full upward position within inner tube 27, closure 35 also closes off the bottom ends 31 and 32 of concentric tubes 27 and 28 for driving or crowding the entire probe 25 downwardly into the earth.

A pressure tank 36 is secured to the top end of outer pipe 28 whereby the sealed interior of tank 36 is registered with the annular space 33 between concentric pipes 27 and 28 for forcing a propping agent under pressure from the interior of tank 36 down into this annular space 33, all the way to the bottom thereof. An airlock access 37 is provided on the top of pressure tank 36 for introduction of the propping agent or particulate material into the interior of tank 36. In addition, a fluid access pipe 38 is also provided for tank 36 for introducing fluid under pressure into tank 36 for assisting in driving the propping agent downwardly into the annular space 33.

A line and pulley arrangement 40 is provided adjacent the top end of concentric pipes 27 and 28 and is configured with line 41 and pulley 42 for pulling the prefabricated drain pipe 10 upwardly into inner pipe 27. Pulley arrangement 40 is sealed off from the annular space 33 as illustrated so as not to permit the propping agent contained within annular space 33 and the interior space of pressure tank 36 to interfere with the pulley arrangement 40 or to find ingress into the interior of pipe 27.

This entire probe 25 is mounted on a carrier such as shown in U.S. Pat. No. 5,800,090. This mounting arrangement permits the probe 25 to be inserted downwardly into and withdrawn from the ground.

The sequence for drain installation is as follows:

1. The pull line 41 extends all the way down through the inner pipe 27 and is clamped to the upper end of precut drain pipe 10, which is also fitted and secured with a sacrificial plate 35 at its bottom end.

2. The drain pipe 10 is pulled up into the interior of tube 27 by the pull line 41 until the sacrificial plate now covers the open bottom ends 31 and 32 of the inner and outer pipes 27 and 28 respectively.

3. The carrier, such as illustrated in U.S. Pat. No. 5,800,090, now locates the probe 25 over the desired drain location.

4. The probe 25 is then vibrated vertically while being crowded downwardly into the ground by the carrier.

5. When the desired penetration depth into the ground is reached, the airlock 37 is opened and a measured amount of particulate material as a propping agent is placed into the pressure tank. This particulate material falls down through the annular space 33 between the two pipes 27 and 28, fully filling this annular space.

6. Air lock 37 is closed and air pressure is introduced into the interior of pressure tank 36 via tube 38 and is controlled to roughly 1 psi per foot of depth of probe penetration into the earth.

7. The probe 25 is then vibrated vertically by the carrier as it is withdrawn. The sacrificial plate remains in the ground anchoring the drain 10. As the probe 25 is withdrawn, the particulate material forms an envelope around the drain. Air pressure is reduced within the interior of pressure tank 36 as the probe is withdrawn.

Figure 5:
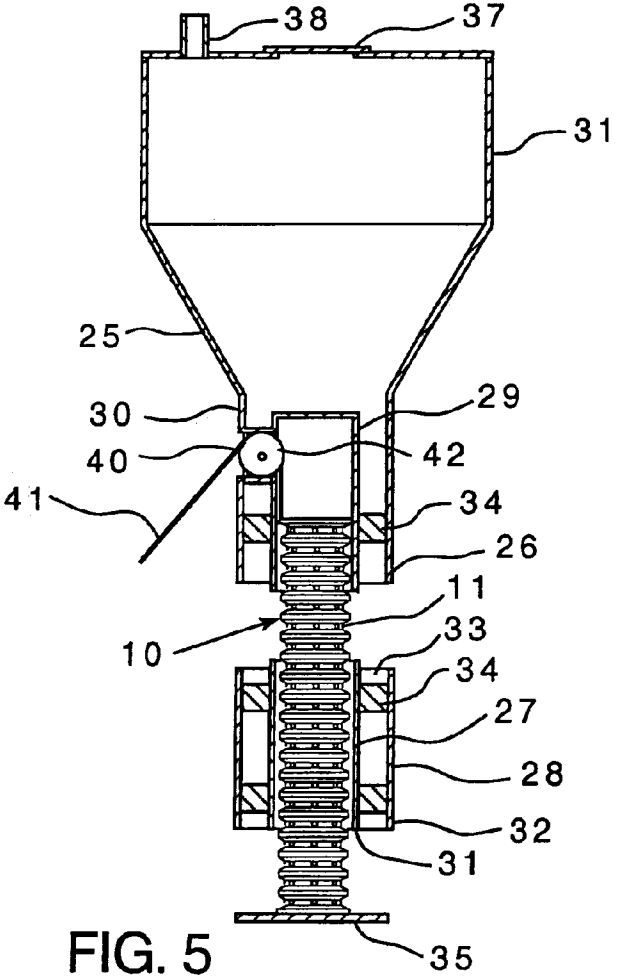
FIG. 5 is a view in vertical mid cross section of the structure shown in FIG. 4.
Figure 4:
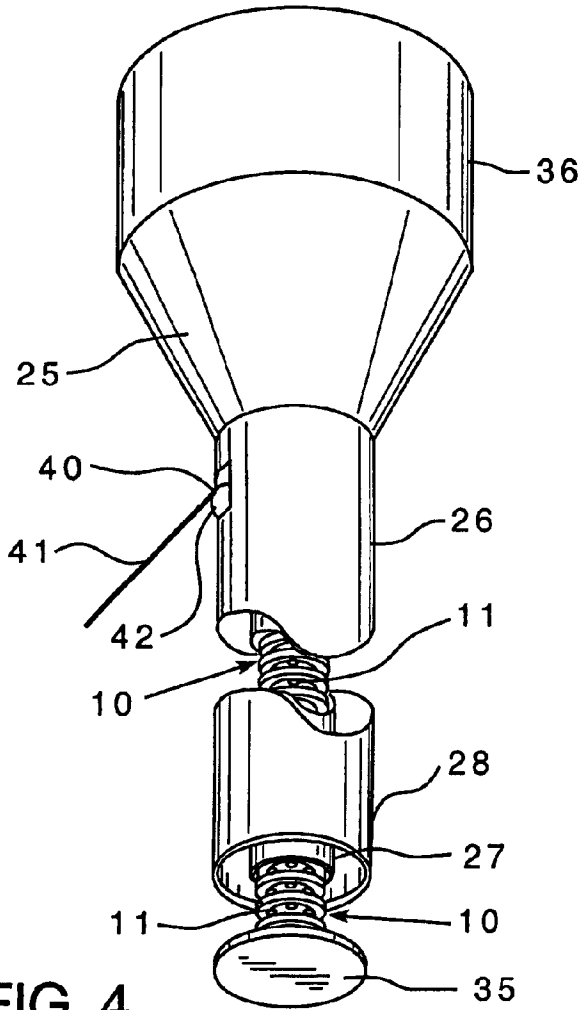
FIG. 4 is a perspective view of a hollow mandrel apparatus for installing prefabricated earth drains in accordance with the teachings of the present invention.
Figure 6:
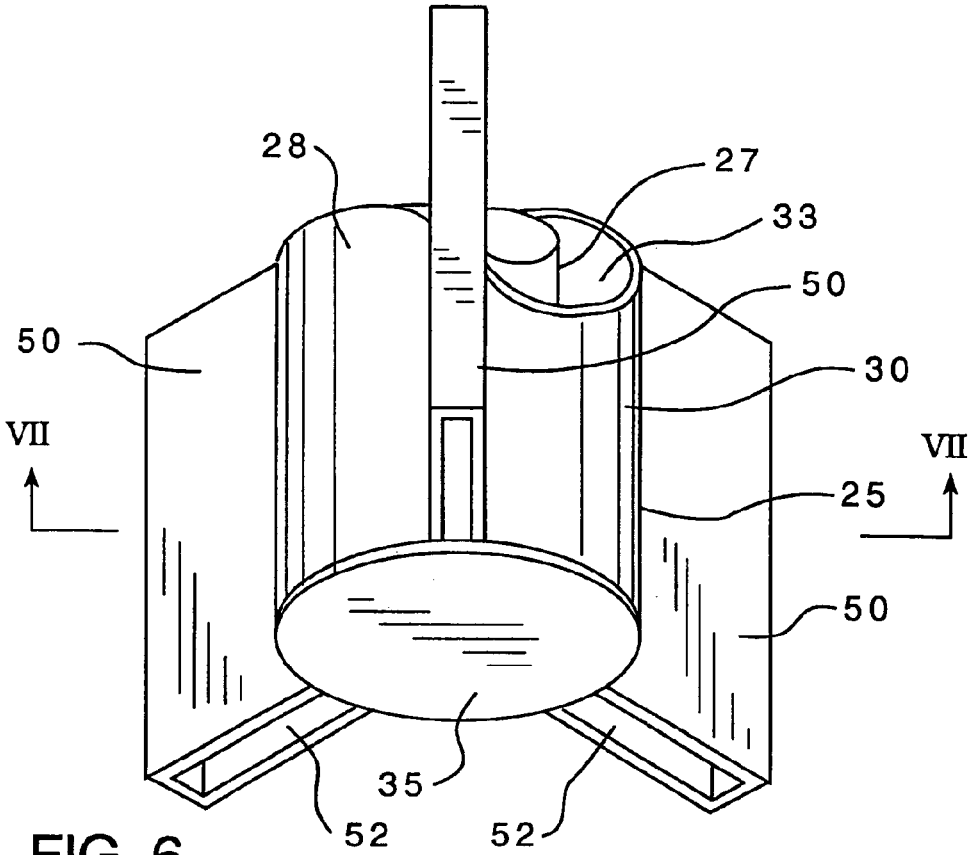
FIG. 6 is a perspective view of the bottom portion of a hollow mandrel apparatus for carrying out an embodiment of the method and apparatus of the present invention which creates radial fissures in the surrounding earth and injects propping agent into the created fissures.
Figure 7:
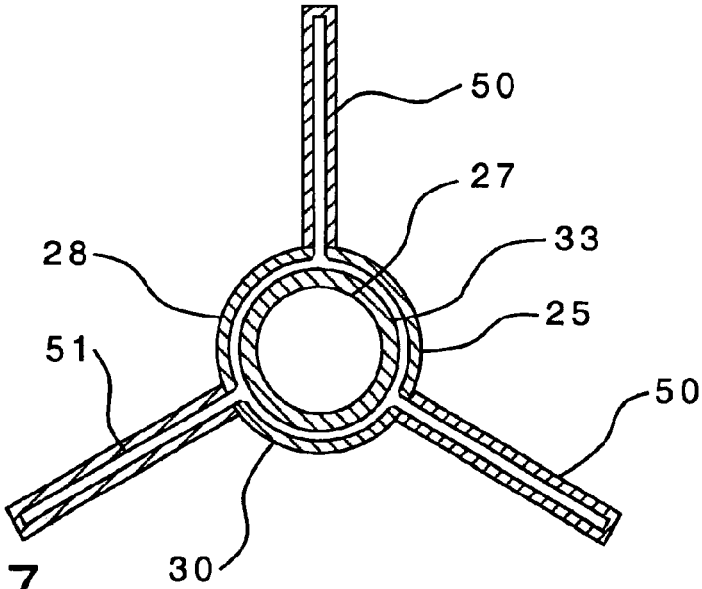
FIG. 7 is a view in cross section of the apparatus shown in FIG. 6 as seen along section line VII—VII.

FIGS. 6 and 7 illustrates a variation of the apparatus shown in FIGS. 4 and 5. This modification permits the apparatus during installation of the drain pipe 10 to provide simultaneous installation of drainage arms or fins of the particulate material. In this arrangement outer pipe 28 includes a plurality, in this instance 3, of uniformly spaced radially and longitudinally extending exterior fins 50 having hollow interiors 51 and open bottom ends 52 which communicate with the annular space 33 whereby propping agent or particulate matter is permitted to expel from the bottom open ends 52 to flow into fissures created in the surrounding soil by fins 50 upon removal of probe 25, together with hollow mandrel 30.

Figure 8:
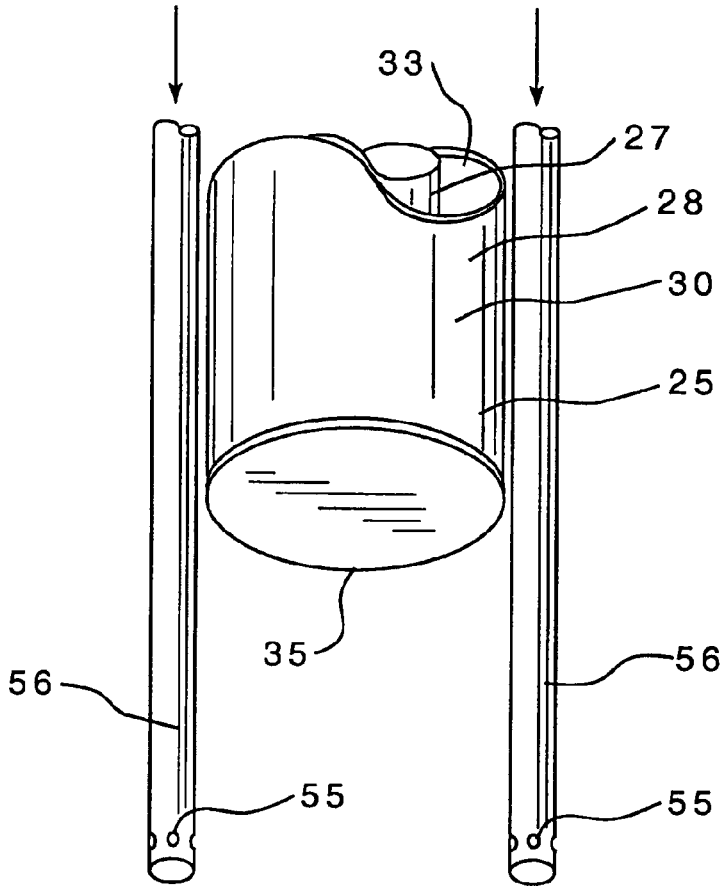
FIG. 8 is a schematic drawing in perspective illustrating the lower end of a hollow mandrel utilized to insert a prefabricated drain downwardly into the earth while hydraulically fracturing the surrounding soil during the insertion process.
Figure 9:
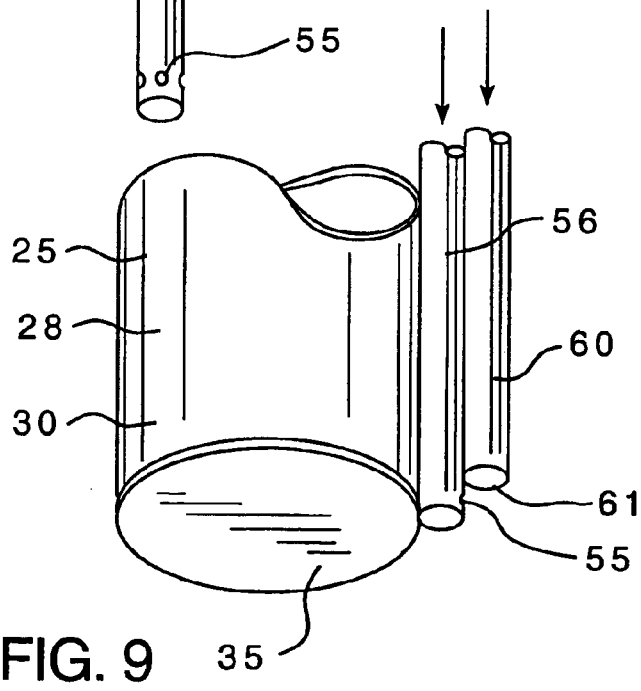
FIG. 9 is a schematic drawing in perspective illustrating the bottom end portion of a hollow mandrel for inserting a prefabricated drain in accordance with the teachings of the present invention while simultaneously applying hydraulic fracturing and expelling propping agent.

The structures illustrated in FIGS. 8 and 9 disclose a further variation of the present invention wherein hydraulic or pneumatic fracturing in accordance with the teachings of the present invention may be accomplished during drain installation. Referring particularly to FIG. 8, fracturing fluid such as air or water is forced into the soil through one or more fluid fracture nozzles 55 located adjacent the bottom ends of the two coextending and juxtapositioned fracture fluid tubes 56. As an alternative, tubes 56 may coextend internally within the drain pipe 10. The nozzles 55 may be provided at the bottom of the probe 25 adjacent sacrificial plate 35 or they may be positioned therebelow as illustrated in FIG. 8. Both the volume and pressure of the fracturing fluid supplied via tubes 56 is sufficiently large enough to cause fracturing of the surrounding soil as the probe 25 is being crowded downwardly into the earth.

One problem which must be overcome with this arrangement is that the fluid flow from the nozzles 55 will "short circuit" to the ground surface as the probe is being crowded downwardly into the earth thereby creating an annular space around the hollow mandrel 30. In order to minimize this problem, the fracturing fluid that exits nozzles 55 is applied in pulses. That is, high volume and high pressure fluid are applied for a short period of time, one to ten seconds. The flow is then shut off for a period of time, for example, from five to ten seconds, during further penetration of the mandrel. These off times and on times are adjusted for specific field conditions.

The pulsing of the hydraulic fracturing fluid thus allows the mandrel to penetrate into virgin soil during the off period through crowding pressures applied by the carrier, thus sealing the bottom part of the mandrel against the surrounding soil. Also, during this period, any fluid in the annular space surrounding the hollow mandrel 30 will have time to drain and the soil further up the mandrel will again come into contact with the mandrel, thus resealing at a higher level. Thus if the on-time is maintained short, fracturing will occur before this newly established seal is broken.

These hydraulic fracturing pipes 56 may also be used in conjunction with any conventional hollow mandrels used in the industry and are not confined exclusively for use with the unique mandrel 30 illustrated.

In the arrangement illustrated in FIG. 8, the fracture fluid is applied through nozzles 55 at the bottom of pipes 56 which extend below the probe tip at sacrificial plate 35. The object of this arrangement is twofold. First, the diameter of any annular short circuit path for the fracture fluid is much smaller around these pipes than that around the probe, and thus a stronger seal is provided. Secondly, since the probe has a larger diameter, sealing around the in situ soil will be more efficient as the probe penetrates into the soil during the fluid off time.

In addition, the hydraulic fluid being ejected from nozzles 55 may be under such pressures and directed whereby jetting action of the fracture fluid is created. In this instance, the nozzles 55 would be smaller and would perform as fluid jets. The fluid is in this instance delivered at a very high pressure of for example from 1,000 to 10,000 psi at a relatively low volume. This jetting action will actually penetrate or cut into the soil to a designated radial distance thus providing an effective preferred drainage channel in the surrounding soil. Additional fracturing beyond this radial distance may also occur an directed in a radial pattern outward from the tip of the probe 25 to create radial fissures or cavities.

As a further alternative, proppants may be suspended in the fracture fluid to aid in maintaining the fractures opened. However, one problem that occurs in this instance is that the propping agent or abrasive can quickly erode the jet orifices of nozzles 55. In order to avoid this situation, the structure of FIG. 9 is provided wherein the propping agent is delivered to the bottom of probe 25 via an independent tube 60 having an open bottom end 61. The proppant is fed downwardly through tube 60 either as a water slurry or a dry compound under air pressure. The pipe 60 terminates slightly above or in front of high pressure jet nozzles 55 whereby the high pressure stream of the fracture fluid emanating from nozzles 55 carrying the proppant which is deposited into the soil fractures being created by the hydraulic jetting.

Chemicals, which undergo a chemical reaction with water or soil, may also be dissolved or suspended in the fracture fluid. One particularly promising approach in this regard would be to use a slurry of unslaked lime as the fracture fluid or jetting fluid. Experience is shown that unslaked lime reacts with clay materials forming materials with permeabilities 500 to 1,000 times that of the undisturbed soil (Broms, B. B. and P. Boman, "Lime Columns—A New Foundation Method," Journal of the Geotechnical Engineering Division, ASCE, Vol. 105, No. GT 4, April 1979).

Figure 10:
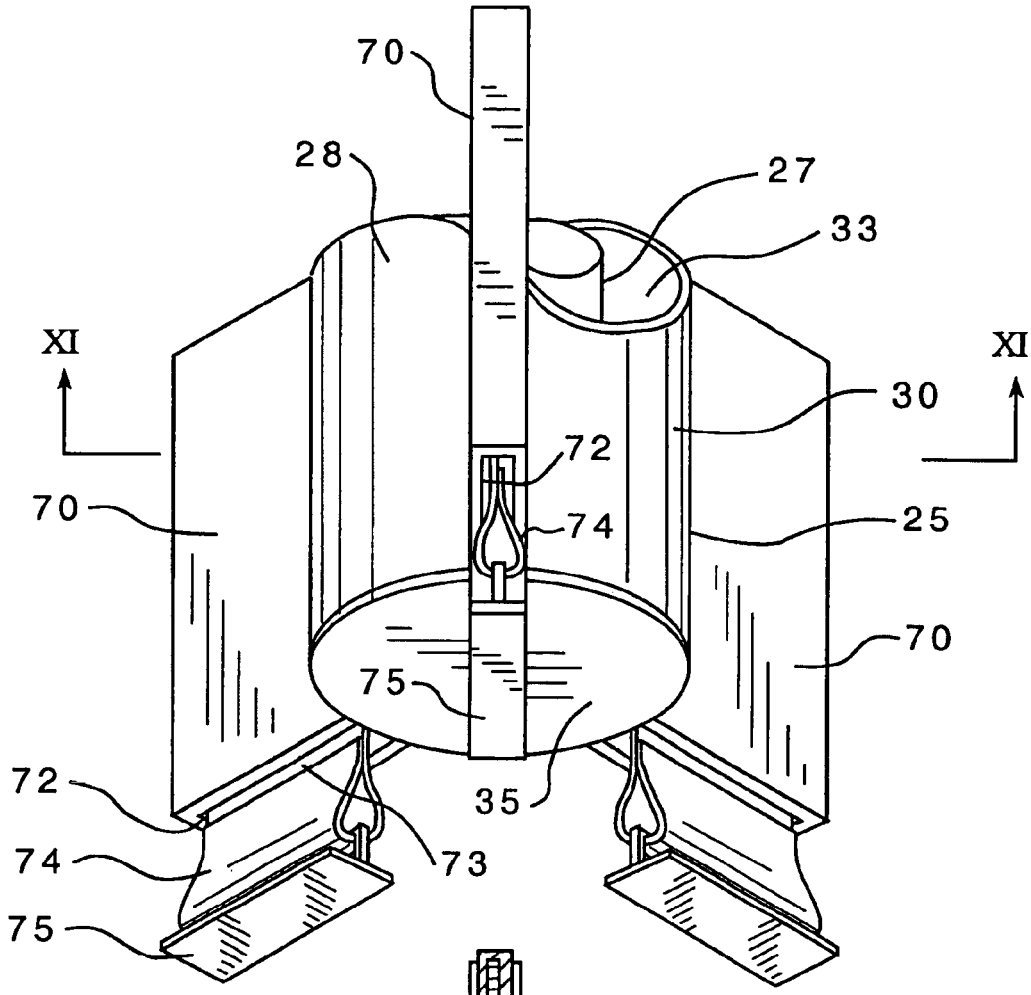
FIG. 10 is a schematic perspective view of the bottom end portion of a hollow mandrel constructed in accordance with the teachings of the present invention for creating radial fissures in the surrounding earth while inserting the mandrel and filling the fissures thereby created with geotextile fabric ribbons upon withdrawal of the mandrel.
Figure 11:
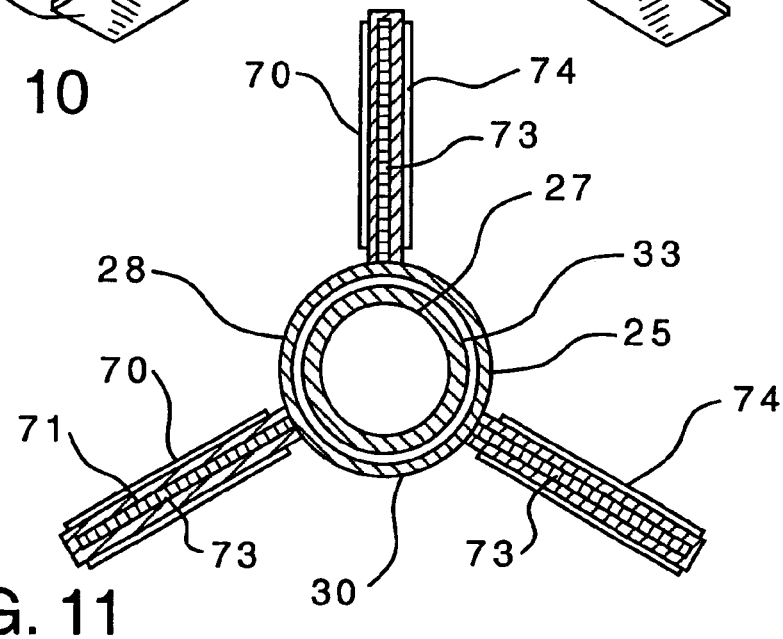
FIG. 11 is a schematic view in cross section of the apparatus shown in FIG. 10 as seen along section line XI—XI.

Turning next to the structure illustrated in FIGS. 10 and 11, the hollow mandrel 30 is again illustrated, but in this embodiment, the outer pipe 28 includes a plurality of uniformly spaced radially and longitudinally extending exterior fins 70 having hollow interiors 71 which do not communicate with the hollow annular space 33 between inner pipe 27 and outer pipe 28. Here the hollow interiors 71 of fins 70 have open top and bottom ends. The open bottom ends 72 are illustrated in FIG. 10. Elongate ribbons 73 of porous filter fabric or geofabric are retained and coextending in the hollow interiors 71 of each of the fins 70 with the bottom ends 74 thereof exposed through the fin bottom openings 72 and respectively secured, such as by stapling to itself, to sacrificial lost anchor closures 75 which close the bottom open ends 72 of fins 70 for driving the probe 28 downwardly into the earth.

This system provides a vertical drain that is installed with uniformly spaced radial drainage appendages or arms in the form of the ribbons 74. The ribbon 74 is fabricated in rolls and is fed down through the hollow interior 71 of fin 70 to terminate at the respective sacrificial anchor plates or lost anchors 75 as shown. The ribbons 74 are pulled back upwardly until the respective lost anchor 75 rest against the bottom of the fins 70. The anchor plates 75 thus prevent mud or soil from entering the hollow chamber 71 containing the ribbons 74. The probe, together with its interior earth drain, is installed as usual as previously explained.

After the probe 28 penetrates to the desired depth it is then withdrawn as with normal installation. The lost anchors 75 stay in the ground and anchor the radial drainage material in the form of ribbons 74 and the central drain, as previously explained, is also retained in the ground by sacrificial plate 35. When the mandrel 30 is withdrawn from the ground, the radial drainage material or ribbons are cut and reattached with fresh anchor plates 75 along with a new central drain pipe 10 and the installation process is repeated for the next drain.

I claim:

1. A method of improving the effectiveness of a prefabricated drain installed in a generally vertical manner in soil to be treated for expelling pore water from the soil, the method comprising:

installing a generally vertical drain with a mandrel in unstable soil which cannot maintain a borehole;

removing the mandrel after installation of the drain; and fracturing soil surrounding said drain by applying hydraulic fracturing.

2. The method of claim 1, wherein said drain is provided in the form of a perforated tube and fracturing of the surrounding soil is accomplished by sealing between upper exterior portions of said tube and surrounding soil and by subjecting fluid within said tube to hydraulic fracturing pressure for fracturing surrounding soil with fluid under pressure applied via perforations in said tube.

3. The method of claim 2, wherein subjecting fluid within said tube to hydraulic fracturing pressure includes subjecting fluid in a preselected segment of said tube with hydraulic fracturing pressure.

4. The method of claim 1, including supplying a propping agent to the surrounding soil after fracturing for propping fractures in the soil.

5. The method of claim 1, including supplying a propping agent to the surrounding soil prior to fracturing for propping fractures in the soil thereafter created by fracturing.

6. The method of claim 1, including hydraulically fracturing the surrounding soil as said drain is being installed with fluid under pressure.

7. The method of claim 6, wherein fracturing includes supplying fracturing fluid under pressure to the surrounding soil in pluses.

8. The method of claim 6, including supplying a propping agent to the surrounding soil being fractured during the step of fracturing.

9. The method of claim 8, wherein the propping agent is supplied in combination with said fracturing fluid.

10. The method of claim 9, wherein said propping agent is a chemical contained in the fracturing fluid which will react to form a permeable material within the fractures.

11. The method of claim 1, including creating radially extending fissures in said surrounding soil.

12. The method of claim 11, wherein said fissures are created by high pressure jets of fluid during the step of installing.

13. The method of claim 12, including supplying a propping agent to said fissures.

14. The method of claim 13, wherein said propping agent is a chemical contained in the fracturing fluid which will react to form a permeable material within the fractures.

15. The method of claim 13, wherein said propping agent supplied to said fissures is supplied in the form of a continuous ribbon of porous filter fabric.

16. A method of improving the effectiveness of a prefabricated composite drain installed in a generally vertical manner in soil to be treated for expelling pore water from the soil, the method comprising:

installing a generally vertical drain with a mandrel in unstable soil which cannot maintain a borehole;

removing the mandrel after installation of the drain; and creating radially extending fissures in the soil surrounding said drain.

17. The method of claim 16, wherein said fissures are created by high pressure jets of fluid during the step of installing.

18. The method of claim 16, including supplying a propping agent to said fissures.

19. The method of claim 18, wherein said propping agent is a chemical contained in the jet fluid which will react to form a permeable material within the fissures.

20. The method of claim 18, wherein said propping agent is supplied in the form of a continuous ribbon of porous filter fabric.

21. The method of claim 16, including hydraulically fracturing soil surrounding said drain.

* * * * *